US009851126B2

(12) United States Patent
Wild

(10) Patent No.: US 9,851,126 B2
(45) Date of Patent: Dec. 26, 2017

(54) COOLING APPARATUS

(75) Inventor: Johannes Wild, Vienna (AT)

(73) Assignee: Johannes Wild, Vienna (AT)

( * ) Notice: Subject to any disclaimer, the term of this patent is extended or adjusted under 35 U.S.C. 154(b) by 384 days.

(21) Appl. No.: 13/809,686

(22) PCT Filed: Jul. 12, 2011

(86) PCT No.: PCT/AT2011/000298
§ 371 (c)(1),
(2), (4) Date: Feb. 25, 2013

(87) PCT Pub. No.: WO2012/006645
PCT Pub. Date: Jan. 19, 2012

(65) Prior Publication Data

US 2013/0205826 A1 Aug. 15, 2013

(30) Foreign Application Priority Data

Jul. 12, 2010 (AT) ..... A 1177/2010

(51) Int. Cl.
*F25B 1/00* (2006.01)
*F25D 19/00* (2006.01)

(52) U.S. Cl.
CPC ..... *F25B 1/00* (2013.01); *F25D 19/00* (2013.01)

(58) Field of Classification Search
CPC .. F25B 9/02; F25B 2309/02; F25B 2309/021; F25B 2309/022; F25B 2309/023;
(Continued)

(56) References Cited

U.S. PATENT DOCUMENTS 3,397,720 A * 8/1968 Jones ..... F16L 59/029 138/149
3,704,391 A * 11/1972 McConnell ..... 218/1
(Continued)

FOREIGN PATENT DOCUMENTS

EP 0650574 A1 5/1995
JP 62224987 A * 10/1987 ..... F25D 3/10
(Continued)

OTHER PUBLICATIONS

Machine Translation for Narasaki et al. (JP H11-063697).*
(Continued)

*Primary Examiner* — Jianying Atkisson
*Assistant Examiner* — Antonio R Febles
(74) *Attorney, Agent, or Firm* — Fitch, Even, Tabin & Flannery, LLP

(57) ABSTRACT

A cooling apparatus having a closed cooling circuit for cooling objects to semi-cryogenic or cryogenic temperatures includes a compressor to compress a gaseous coolant, and from which the coolant exits in a compressed gaseous state, an after-cooler connected downstream from the compressor, whereby the coolant exits largely in gaseous form, a counterflow heat exchanger having a feed line and return line arranged in such a way that the compressed coolant is liquefied in the feed line as the relieved coolant flowing through the return line is being heated. A cooling head that is connected with the feed line and return line. A coolant can flow through the cooling head whereby the coolant evaporates. The cooling head is arranged in a vacuum chamber, which can be joined with a low-pressure source, and is joined by flexible connecting lines with the feed line and return line of the counterflow heat exchanger.

17 Claims, 2 Drawing Sheets

Figure 1:
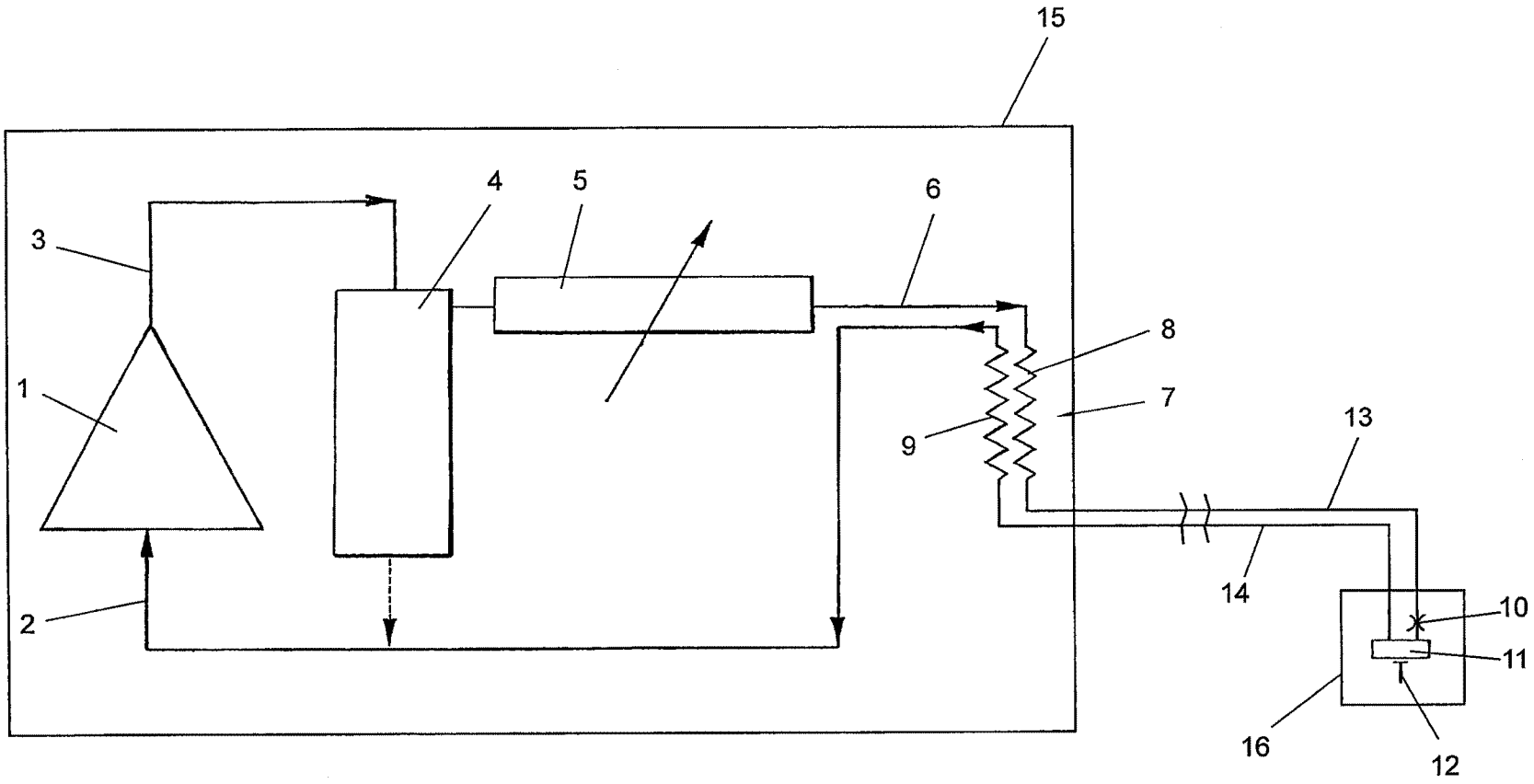

(58) Field of Classification Search
CPC ..... F16L 59/065; F16L 59/07; F16L 59/075; F16L 9/18; F16L 39/005
USPC ..... 62/51.1, 52.1
See application file for complete search history.

(56) References Cited

U.S. PATENT DOCUMENTS

| | | | | | |
|---|---|---|---|---|---|
| 4,192,655 | A | * | 3/1980 | von Linde | 48/191 |
| 5,060,481 | A | * | 10/1991 | Bartlett et al. | 62/51.2 |
| 5,275,595 | A | | 1/1994 | Dobak, III | |
| 5,337,572 | A | | 8/1994 | Longsworth | |
| 5,353,603 | A | * | 10/1994 | Outlaw et al. | 62/149 |
| 5,687,574 | A | | 11/1997 | Longsworth et al. | |
| 5,758,505 | A | * | 6/1998 | Dobak et al. | 62/6 |
| 5,768,911 | A | * | 6/1998 | Dube | 62/505 |
| 6,442,948 | B1 | * | 9/2002 | Takeda | 62/48.2 |
| 2005/0086950 | A1 | | 4/2005 | Khatri | |

FOREIGN PATENT DOCUMENTS

| | | | | | |
|---|---|---|---|---|---|
| JP | 06273025 | A | * | 9/1994 | F25D 3/10 |
| JP | 11063697 | A | * | 3/1999 | F25B 9/00 |
| WO | 97/33671 | A1 | | 9/1997 | |
| WO | 02/01123 | A1 | | 1/2002 | |

OTHER PUBLICATIONS

International Search Report dated Oct. 5, 2012, issued in International Application PCT/AT2011/000298.
International Preliminary Examination Report issued in International Application PCT/AT2011/000298.

* cited by examiner

COOLING APPARATUS

CROSS-REFERENCE TO RELATED APPLICATIONS

This Application is a U.S. National Stage Application filed under 35 U.S.C. §371 of International Application PCT/AT2011/000298, filed Jul. 12, 2011, designating the United States, which claims priority from Austrian Patent Application A 1177/2010, filed Jul. 12, 2010, the complete disclosures of which are hereby incorporated herein by reference in their entirety for all purposes.

The invention relates to a cooling apparatus with a closed cooling circuit for cooling objects to semi-cryogenic or cryogenic temperatures of 230 K to 80 K, comprising a compressor for compressing a coolant, to which the coolant is supplied in a gaseous state, and from which the coolant exits in a compressed gaseous state, an after-cooler connected downstream from the compressor, a counterflow heat exchanger comprising a feed line and return line, which are arranged in such a way that the compressed coolant can be liquefied in the feed line as the relieved coolant flowing through the return line is being heated, and a cooling head that is connected with the feed line and return line and has coolant flowing through it, in which the coolant evaporates.

For example, such a cooling apparatus may be gleaned from Document EP 650574 A1.

In commercial cooling systems, the counterflow heat exchanger and cooling head are combined into a structural unit, and arranged in a vacuum chamber, in which the object to be cooled is also placed. The counterflow heat exchanger situated in the vacuum chamber is here integrated into the cooling circuit via flexible gas feed lines. The fact that the coolant in the flexible gas feed lines is at room temperature, and is only brought to semi-cryogenic or cryogenic temperatures in the vacuum chamber, eliminates the requirement that these lines be insulated. This avoids problems associated with transporting coolant cooled to semi-cryogenic or cryogenic temperatures via flexible lines, e.g., icing, formation of condensate, as well as heat losses. However, the disadvantage is that the devices require a large vacuum chamber, which is undesired or even unusable for many processes. This is because the heat exchangers used in such devices are generally several meters long and wound into a spiral to achieve a certain level of compactness for the cooling head with the heat exchanger. Nevertheless, the heat exchangers are already relatively large (approx. 200 mm high with a diameter of 80 mm) at low outputs (e.g., −130° C. at 30 W). In addition, such a cooling system requires a good vacuum system, since the volume of the vacuum chamber must be correspondingly large. In existing devices (e.g., Polycold-Cryotigers) that use the mixed gas Joule Thomson process (see EP 650574 A1) and have the counterflow heat exchanger with cooling head in the vacuum chamber, an increased cooling capacity is accompanied by a distinctly larger heat exchanger. In particular at higher cooling capacities (approx. >50 W), such devices are no longer economically viable or attractive, in particular for scientific applications (e.g., heavy duty laser amplifiers, e.g., 150 W at 130 K, laser crystals measuring 3 mm×6 mm, for example), in which small vacuum chambers are desired.

Therefore, the object of the invention is to improve a cooling apparatus in such a way that an object can be efficiently cooled to the lowest possible semi-cryogenic or cryogenic temperatures, wherein the vacuum chamber is simultaneously to exhibit as small and convenient as possible, while at the same time significantly raising the capacity (e.g., 200 W/140 K instead of 30 W/140 K). In addition, losses incurred while transporting the coolant are to be minimized.

This object is achieved by further developing the cooling apparatus of the kind mentioned at the outset according to the invention essentially in such a way as to arrange the cooling head in a vacuum chamber that can be connected with a low-pressure source, and is joined by flexible connecting lines with the feed line and return line of the counterflow heat exchanger, so that the counterflow heat exchanger is situated outside the vacuum chamber. Therefore, the invention is based on the idea of using the conventional mixed JT method, and executing the process of liquefying the coolant with the counterflow heat exchanger separately from the vacuum chamber. As a consequence, the coolant is liquefied outside of the vacuum chamber, wherein the liquefied coolant is supplied to the vacuum chamber by way of flexible connecting lines. One must here only make sure that the heat exchanger and connecting lines have been thermally insulated in a suitable manner. For example, the heat exchanger can be insulated with the help of a separate vacuum chamber with vacuum pump or more simply with insulating materials made out of expanded polystyrene (EPS), insulating materials made out of extruded polystyrene (XPS), insulating materials made out of polyurethane (PUR), or by means of a vacuum insulating plate (VIP). Since the configuration according to the invention makes it possible to multiply the cooling capacities, any losses owing to at best a more poorly insulated heat exchanger only play a secondary role. For example, capacities were realized on a cooling head with (cylinder: H 35 mm×D 35 mm) 300 W/140 K. This corresponds to a tenfold increase in cooling capacity given an approx. thirtyfold volumetric reduction. In order to improve the thermal insulation, in particular at lower temperatures, a thermal radiation reflecting layer made out of aluminium foil or equivalent material can be introduced into the insulation of the heat exchanger. For example, this yields a structural design for the layer following the pattern EPS, aluminium film, EPS, aluminium film, . . . .

The configuration according to the invention makes it possible to design the cooling aggregate and cooling head as functionally separate units, so that the cooling head itself need not incorporate any large components of the cooling aggregate, for example a counterflow heat exchanger or the like. This further makes it possible to provide a cooling aggregate with the respectively required cooling capacity that reflects the respective requirements, without the cooling head having to be adjusted in any way whatsoever, and without impairing the operability of the cooling head in any way whatsoever.

In a preferred further development, an especially simple operability is ensured by arranging the compressor, after-cooler and counterflow heat exchanger together in a floor-mounted device, the housing of which exhibits a lead-through for the connecting lines that join the counterflow heat exchanger with the vacuum chamber.

In the mixed gas Joule Thomson cooling aggregate, it is crucial that the cooler be connected to the feed line of the counterflow heat exchanger with a throttle interspersed, so that the necessary pressure reduction of the coolant takes place, and the liquefied coolant can evaporate in the cooling head. In this conjunction, an especially advantageous structural design provides that the connecting line joining the feed line of the counterflow heat exchanger with the cooling head forms the throttle.

In order to minimize the thermal losses while transporting the coolant through the connecting lines, a preferred further development of the invention provides that the connecting lines exhibit vacuum insulation. It can preferably be provided here that the vacuum chamber and vacuum insulation of the connecting lines are joined directly together, and can be joined with a shared low-pressure source. The advantage to this is that the vacuum system of the vacuum chamber is used for suitably insulating the coolant during its transport between the vacuum chamber or cooling head and the cooling reservoir, and set up a vacuum lead-through. The vacuum chamber itself incorporates the cooling head (e.g., made out of copper), which is secured to the connecting lines and carries the coolant (e.g., liquid nitrogen) coming from the connecting lines. The existing vacuum chamber is here expanded by the relative slight volume of the vacuum insulation for the connecting lines, and a vacuum connection is simultaneously established between the vacuum insulation for the connecting lines and the vacuum chamber. This resolves the problem associated with the vacuum lead-through and insulation for the connecting lines at a low outlay and cost. It is here preferably provided that the vacuum chamber exhibits a lead-through for the connecting lines, which is configured in such a way that the hollow space of the vacuum insulation for the connecting lines is joined with the interior space of the vacuum chamber.

The coolant-carrying line is guided out of the vacuum insulation at the other end of the connecting lines, i.e., on the side of the cooling reservoir, as also suitable in vacuum-insulated tubes known from prior art. Attention must here be paid in particular to the thermal conductivity of the cladding tube of the vacuum insulation and the thermal transfer surface. Focus must likewise be placed on a good vacuum welding at the transition. This transition should trigger slight heat transfer losses, and can be additionally protected against condensate or ice by means of conventional insulation.

Based on the embodiment described, it now becomes possible to introduce any cooling capacities desired in a vacuum chamber in an extremely efficient, space-saving (volume-saving) manner, depending on the dimensioning of the respective cooling aggregate.

In a preferred further development of the invention, an especially simple structural design for the vacuum insulation for the connecting lines is achieved if the vacuum insulation comprises a cladding tube that envelops the connecting lines, with the formation of a preferably essentially annular hollow space. The cladding tube can be just as flexible as the connecting lines. To prevent the connecting lines from contacting the cladding tube, which would lead to an undesirable heat transfer, the embodiment is preferably configured in such a way as to arrange at least one spacer in the hollow space between the connecting lines and the cladding tube. Having the spacer exhibit a preferably provided corrugated outer and inner contour ensures that only point-shaped or linear contacts arise between the spacer on the one hand and the cladding tube and connecting lines on the other, wherein such Hertzian contacts make it possible to further diminish the introduction of heat from outside.

A particularly simple structural design is achieved according to a preferred further development by joining the shared low-pressure source to the vacuum chamber.

It is further preferably provided that the vacuum chamber incorporate in particular a tubular spacer, which envelops the lead-through, and defines the distance between the cooling head and the inner wall of the vacuum chamber, wherein the spacer exhibits radial through holes, so that the interior space of the vacuum chamber is joined with the hollow space of the vacuum insulation for the connecting lines.

The coolant preferably comprises butane and/or isobutane and/or propane and/or propene and/or ethyne and/or ethane and/or ethene and/or methane and/or argon and/or nitrogen.

Figure 3:
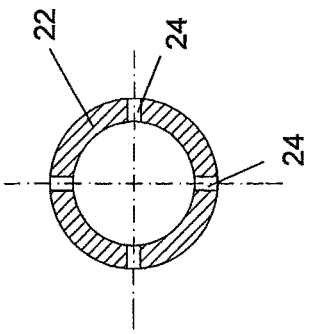

The invention will now be explained in greater detail based on exemplary embodiments schematically depicted on the drawing. In the latter, FIG. 1 presents a closed coolant circuit with a cooling aggregate and a cooling head, FIG. 2 a sectional view of the cooling head with the connecting lines, and FIG. 3 a section according to line III-III on FIG. 2.

The coolant circuit shown on FIG. 1 is most often referred to as a mixed gas Joule Thomson cooling process, and is described, for example, in Document EP 650574 A1. The coolant circuit comprises a compressor 1 for compressing the coolant supplied in gaseous form at 2. For example, the coolant can be a gas mixture consisting of propane, ethane, methane and nitrogen. The compressed coolant is fed via a line 3 to an oil separator 4, with which the oil potentially being mixed with the coolant in the compressor 1 is separated out. The coolant cleansed of oil is subsequently fed to an after-cooler 5, in which the heat supplied to the compressor 1 is removed from the coolant. The cooled, compressed, but still most often gaseous coolant is then fed via a line 6 to a counterflow heat exchanger 7, in which the coolant flowing through the coolant feed line 8 is cooled and liquefied by the coolant flowing in the coolant return line 9. In practice, the coolant feed line 8 and coolant return line 9 can be several meters long, and are often helically or spirally wound, so as to achieve a certain compactness of the thermal flow heat exchanger. The liquefied coolant is relieved by way of a throttle 10, so that the coolant can evaporate in the cooling head 11, allowing it to remove heat of evaporation from the environment. Since coolant passes through the cooling head 11, the latter is designed as a hollow cylinder, for example. As a consequence, the coolant flowing back from the cooling head 11 is heated to room temperature in the counterflow heat exchanger 7, wherein the returning coolant cools the inflowing coolant. In order to cool an object schematically marked 12, the latter is brought into contact with the cooling head 11. Therefore, the cooling head 11 consists of a thermally conductive material, such as copper.

According to the invention, the cooling head 11 is joined with the counterflow heat exchanger 7 by connecting lines 13 and 14, so that the cooling aggregate 15 and the cooling head 11 arranged in a vacuum chamber 16 can be realized as separate structural units. The configuration according to the invention requires that the coolant cooled and liquefied in the heat exchanger 7 be transported over a more or less long distance by way of the connecting lines 13 and 14, so that a sufficient insulation must be ensured for the connecting lines.

Figure 2:
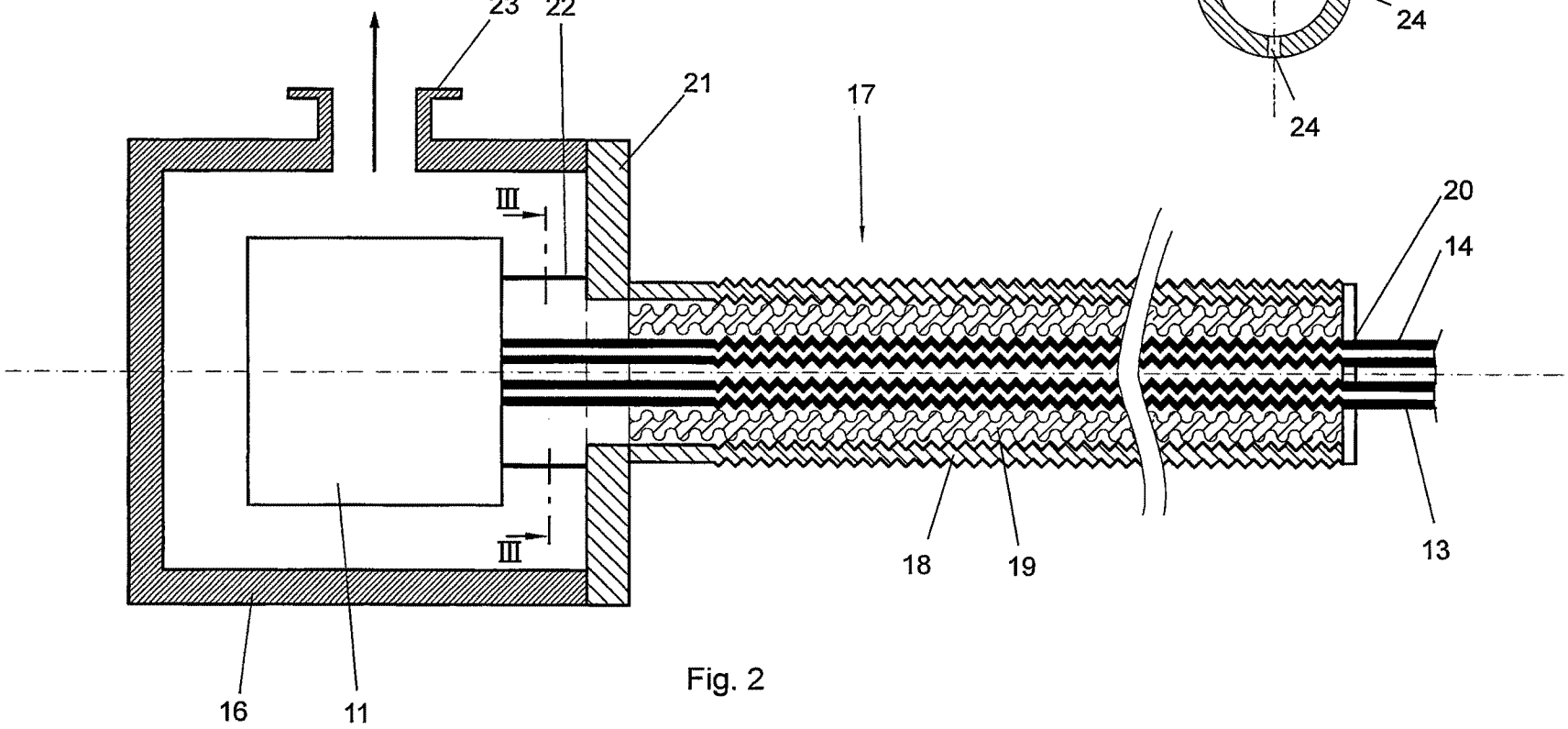

FIG. 2 provides a more detailed view of the cooling head with vacuum chamber, along with the connecting lines. As evident, the connecting lines 13 and 14 exhibit a vacuum insulation 17, the evacuated interior space of which is connected with the interior space of the vacuum chamber 16. The connecting lines 13 and 14 can here be designed as flexible tubes, so as to improve operability. The vacuum insulation 17 of the connecting line exhibits a flexible cladding tube 18, for example which can be designed as a stainless steel corrugated tube that preferably exhibits a steel jacket. The connecting lines 13 and 14 can also exhibit a corrugated outer contour, and have arranged between them spacers 19 that can also be flexible in design. The spacers 19 preferably exhibit a corrugated outer contour, so that the resultantly achieved linear contacts with the cladding tube 18 or connecting lines 13 and 14 minimize the heat transfer. As a consequence, the spacer 19 is used to mechanically, and hence thermally, decouple the connecting lines 13 and 14 to the cladding tube 18. It should be sufficiently flexible, temperature stabile, ageing resistant and outgassing free (e.g., Teflon, plastic, stainless steel). The connecting lines 13 and 14 are routed out of the vacuum insulation 17 at point 20. An eye must be kept out for slight thermal losses at the transition point 20. This can be achieved using materials with a slight thermal conductivity and a slight transition cross section (e.g., stainless steel). In addition, the transition point 20 can also be protected by conventional materials for heat insulation (e.g., foamed polystyrene, Armaflex).

The connecting lines 13 and 14 can be thermally coupled. Alternatively, the connecting lines 13 and 14 can also be telescoped into each other. Depending on the cross section and length of the connecting line 13, the coolant can undergo a pressure reduction along the feed line, so that the coolant evaporates in the cooling head, just as in compression refrigeration machines, and heat is dissipated. In this case, the feed line simultaneously acts as the throttle.

The vacuum insulation 17 is joined with a vacuum flange 21, through which the connecting lines 13 and 14 are passed, and routed to the cooling head 11. In order to improve the mechanical stability of the cooling head 11, the cooling head 11 and vacuum flange 21 have arranged between them a spacer 22, for example which can consist of Teflon, ceramic or stainless steel, and should be outgassing-resistant, low temperature-suitable, embrittlement-resistant and ageing-resistant. Care must here be taken to ensure that the spacer 22 is thermally decoupled from the vacuum flange 21 to a sufficient extent, and that there is a good atmospheric permeability relative to the cladding tube 18. As evident from the cross sectional view on FIG. 3, the spacer 22 exhibits several radial through holes 24, so that the evacuated interior space of the vacuum insulation for the connecting lines is conductively connected with the evacuated interior space of the vacuum chamber 16. A flange or port for connection to a vacuum pump is marked 23.

The cooling head becomes extremely low-vibration if coolant flows uniformly through the cooling head and the cooling head is mechanically stabilized by means of spacers.

Typical areas of application for the invention include the cooling of heavy duty laser amplifiers as well as various cooling operations in analytical chemistry, in the field of superconductivity, astronomy, and also generally in research and development, along with medical diagnostics.

The invention claimed is:

1. A cooling apparatus with a closed cooling circuit, said closed cooling circuit configured for cooling objects to semi-cryogenic or cryogenic temperatures of 230 K to 80 K, said closed cooling circuit for cooling objects to said semi-cryogenic or cryogenic temperatures according to the Joule Thomson cooling process, said cooling apparatus comprising a compressor for compressing a gaseous coolant supplied to the compressor in a gaseous state so as to obtain a compressed gaseous coolant, and said coolant exiting in a compressed gaseous state from said compressor, an after-cooler connected downstream from the compressor, from which the coolant exits largely in gaseous form, a counterflow heat exchanger (7) comprising a feed line and a return line, which are arranged in such a way that the compressed coolant is liquefied in the feed line as the relieved coolant flowing through the return line is being heated, a cooling head (11) that is connected with the feed line to receive the liquefied coolant from the feed line and connected with the return line and has the coolant flowing through said cooling head in which the liquefied coolant evaporates, a vacuum chamber (16), and a throttle (10), wherein the cooling head (11) is arranged in the vacuum chamber (16), which is adapted for joinder with a low-pressure source, and is joined by flexible connecting lines (13, 14) with the feed line and return line (8, 9) of the counterflow heat exchanger (7), the counterflow heat exchanger is situated outside of and not in the vacuum chamber in which the cooling head is arranged, and the counterflow heat exchanger is not arranged in any other vacuum chamber, the connecting lines (13, 14) have vacuum insulation (17), the vacuum insulation (17) having a hollow space, the vacuum chamber (16) having a lead-through for the connecting lines (13, 14), the vacuum chamber configured such that the hollow space of the vacuum insulation (17) for the connecting lines (13, 14) is joined with the interior space of the vacuum chamber (16), the cooling head (11) is connected to the feed line (8) of the counterflow heat exchanger (7) with the throttle (10) disposed between said feed line and the cooling head, and the vacuum chamber (16) and the vacuum insulation (17) for the connecting lines (13, 14) are directly joined together, and are configured for joinder with a shared low-pressure source.

2. The cooling apparatus according to claim 1, wherein the vacuum insulation (17) comprises a cladding tube (18) that envelops the connecting lines (13, 14), with the formation of an essentially annular hollow space, wherein the hollow space can be joined with a low-pressure source.

3. The cooling apparatus according to 2, wherein the cooling apparatus further comprises at least one spacer (19) is arranged in the hollow space between the connecting lines (13, 14) and the cladding tube (18).

4. The cooling apparatus according to claim 3, wherein the spacer (19) exhibits a corrugated outer and inner contour.

5. The cooling apparatus according to claim 2, wherein the vacuum chamber (16) includes a port (23) for connecting the shared low-pressure source.

6. The cooling apparatus according to claim 1, wherein the vacuum chamber (16) incorporates a tubular spacer (22), said spacer envelops the lead-through, and defines the distance between the cooling head (11) and an inner wall of the vacuum chamber (16), said spacer (22) having radial through holes (24).

7. The cooling apparatus according to claim 1, wherein the coolant comprises butane and/or isobutane and/or propane and/or propene and/or ethyne and/or ethane and/or ethene and/or methane and/or argon and/or nitrogen.

8. The cooling apparatus according to claim 1, wherein the coolant comprises a butane, isobutene, propane, propene, ethyne, ethane, ethane, methane, argon, or a combination of any thereof.

9. A cooling apparatus having a closed cooling circuit, said closed cooling circuit configured for cooling objects to semi-cryogenic or cryogenic temperatures of 230 K to 80 K, said closed cooling circuit for cooling objects to said semi-cryogenic or cryogenic temperatures according to the Joule Thomson cooling process, said cooling apparatus comprising a compressor for compressing a gaseous coolant supplied to the compressor in a gaseous state so as to obtain a compressed gaseous coolant, and said coolant exiting in a compressed gaseous state from said compressor;

an after-cooler (5) connected downstream from the compressor, from which the coolant exits largely in gaseous form;

a counterflow heat exchanger comprising a feed line and a return line, which are arranged in such a way that the compressed coolant is liquefied in the feed line as the relieved coolant flowing through the return line is being heated;

a cooling head (11) that is connected with the feed line to receive the liquefied coolant from the feed line and connected with the return line and has the coolant flowing through said cooling head in which the liquefied coolant evaporates;

a vacuum chamber (16), and a floor mounted device, wherein the cooling head (11) is arranged in the vacuum chamber, which is adapted for joinder with a low-pressure source, and is joined by flexible connecting lines (13, 14) with the feed line and return line (8, 9) of the counterflow heat exchanger (7), the counterflow heat exchanger (7) is situated outside of and not in the vacuum chamber (16) in which the cooling head is arranged, and the counterflow heat exchanger is not arranged in any other vacuum chamber, the connecting lines (13, 14) have vacuum insulation (17), the vacuum chamber (16) and the vacuum insulation (17) for the connecting lines (13, 14) are directly joined together, and are configured for joinder with a shared low-pressure source, and the compressor (1), after-cooler (5) and counterflow heat exchanger (7) are situated together in the floor-mounted device, the floor-mounted device further comprising a housing having a lead-through for the connecting lines (13, 14) that join the counterflow heat exchanger (7) with the vacuum chamber (16).

10. The cooling apparatus according to claim 9, wherein the cooling head (11) is connected to the feed line (8) of the counterflow heat exchanger (7) with a throttle (10) disposed between said feed line and the cooling head.

11. The cooling apparatus according to claim 10, wherein the connecting line (13) joining the feed line (8) of the counterflow heat exchanger (7) with the cooling head (11) forms the throttle (10).

12. The cooling apparatus according to claim 9, wherein the vacuum insulation (17) having a hollow space, the vacuum chamber (16) having a lead-through for the connecting lines (13, 14), the vacuum chamber configured such that the hollow space of the vacuum insulation (17) for the connecting lines (13, 14) is joined with the interior space of the vacuum chamber (16).

13. The cooling apparatus according to claim 9, wherein the coolant comprises a butane, isobutene, propane, propene, ethyne, ethane, ethane, methane, argon, nitrogen, or a combination of any thereof.

14. A cooling apparatus equipped with a closed cooling circuit for cooling objects to semi-cryogenic or cryogenic temperatures of 230 K to 80 K, said closed cooling circuit for cooling objects to said semi-cryogenic or cryogenic temperatures according to the Joule Thomson cooling process, said cooling apparatus comprising (a) a cooling aggregate having:

(i) a compressor for compressing a coolant supplied to the compressor in a gaseous state, wherein the coolant exits said compressor in a compressed gaseous state, (ii) an after-cooler connected downstream from the compressor from which after-cooler the coolant exits largely in gaseous form, (iii) a counterflow heat exchanger comprising a feed line and a return line, which are arranged in such a way that the compressed coolant is liquefied in the feed line as the relieved coolant flowing through the return line is being heated, and (iv) respective connecting lines for the feed line and for the return line, (b) a cooling head that is connected with the feed line to receive the liquefied coolant from the feed line and connected with the return line, wherein said cooling head is configured so that the coolant flows through the cooling head and the liquefied coolant evaporates, (c) a vacuum chamber for containing the cooling head, and (d) a throttle, wherein the cooling head is arranged within the vacuum chamber, which can be joined with a low-pressure source, and the cooling head is joined to the counterflow heat exchanger through the respective connecting lines with the feed line and return line, the counterflow heat exchanger is separate from and situated outside the vacuum chamber in which the cooling head is arranged, and the counterflow heat exchanger is not arranged in any other vacuum chamber, the connecting lines have vacuum insulation, the throttle is between the cooling head and the counterflow heat exchanger, and the vacuum chamber and the vacuum insulation for the connecting lines are directly joined together.

15. The cooling apparatus according to claim 14, wherein the compressor, after-cooler and counterflow heat exchanger are situated together in a floor-mounted device, the floor-mounted device further comprising a housing having a lead-through for the connecting lines (13, 14) that join the counterflow heat exchanger (7) with the vacuum chamber (16).

16. The cooling apparatus according to claim 14, wherein the vacuum chamber incorporates a tubular spacer, said spacer envelops the lead-through, and defines the distance between the cooling head and an inner wall of the vacuum chamber, said spacer having radial through holes.

17. The cooling apparatus according to claim 14, wherein the coolant comprises a butane, isobutene, propane, propene, ethyne, ethane, ethane, methane, argon, nitrogen, or a combination of any thereof.

* * * * *